United States Patent [19]

Darling et al.

[11] Patent Number: 4,457,430

[45] Date of Patent: Jul. 3, 1984

[54] TAMPER RESISTANT SECURITY PACKAGE

[75] Inventors: Stewart A. Darling; Tadeusz Kostanecki; George Soos, all of Toronto, Canada

[73] Assignee: DRG Inc., Toronto, Canada

[21] Appl. No.: 504,003

[22] Filed: Jun. 13, 1983

[30] Foreign Application Priority Data

Jun. 25, 1982 [GB] United Kingdom ..... 8218460

[51] Int. Cl.[3] ..... B65D 73/00

[52] U.S. Cl. ..... 206/459; 206/807

[58] Field of Search ..... 206/205, 459, 807, 524.2, 206/524.3, 524.9

[56] References Cited

U.S. PATENT DOCUMENTS

| | | | |
|---|---|---|---|
| 3,952,869 | 4/1976 | Sansom | 206/807 |
| 4,197,947 | 4/1980 | Zaidi | 206/459 |
| 4,206,844 | 6/1980 | Thukamoto et al. | 206/459 |
| 4,247,563 | 1/1981 | Sample | 206/459 |
| 4,416,375 | 11/1983 | Braverman et al. | 206/459 |
| 4,424,911 | 1/1984 | Resnick | 206/807 |

*Primary Examiner*—Joseph M. Moy

*Attorney, Agent, or Firm*—Robert F. Delbridge; Arne I. Fors

[57] ABSTRACT

A tamper-resistant package for an article to which access is intended only by destruction of the package has two webs of sheet material having inner surfaces securable together around their peripheries to form the package with the article lying between the webs. A solvent indicator ink is printed on one of the webs, the solvent indicator ink containing an organic dye which bleeds to a visible part of the package upon application of a readily-available common polar or non-polar solvent. A water-sensitive coating is provided on one of the webs to produce a visible indication if an attempt is made to open the package with water, and a heat-sensitive ink is printed on one of the webs to produce a visible change when an attempt is made to open the package by the use of heat.

15 Claims, 1 Drawing Figure

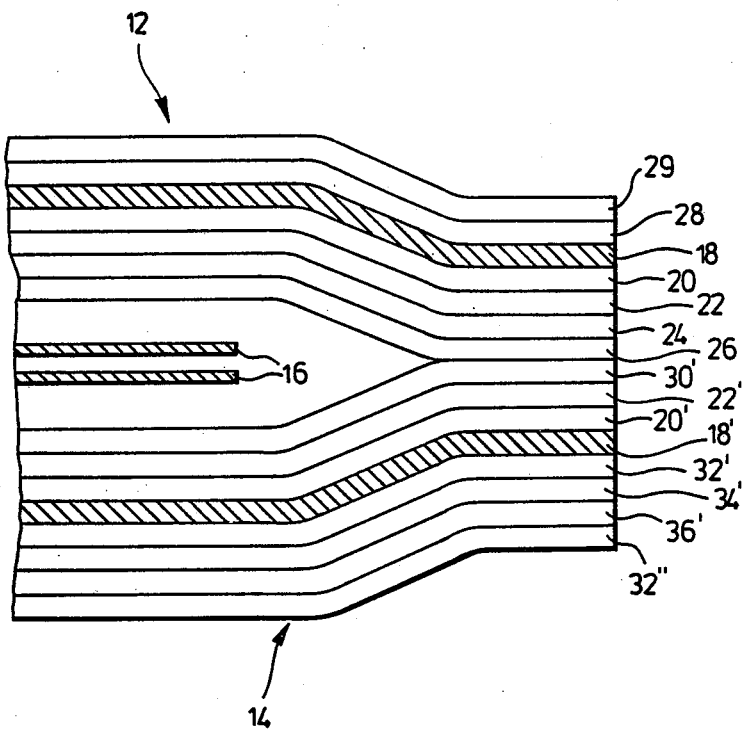
12
29
28
18
20
22
24
26
30'
22'
20'
18'
32'
34'
36'
32"
16
14

TAMPER RESISTANT SECURITY PACKAGE

This invention relates to tamper-resistant and tamper-evident security packages for articles to which access is intended only by destruction of the package. Such articles may be information-carrying articles, for example lottery tickets.

It is now common practice for lottery tickets to be sold in tamper-resistant packages which have to be destroyed in order to obtain access to the lottery tickets therein. Unsold packages can be returned to the lottery organizer by a ticket seller after a lottery draw has taken place, provided that the packages have not been tampered with. If a lottery ticket could be inspected without leaving any evidence that its package had been tampered with, it would be possible for someone to check unsold packages after a lottery draw has taken place to see if any contain a winning ticket.

To be effectively tamper-resistant, such a package must be resistant to tampering by various different methods, such as opening by use of water or other liquids, heat or mechanical means which permit resealing.

However, previously known packages for this purpose have been deficient in anti-temperature properties, and therefore it is an object of the present invention to provide an improved tamper-resistant and tamper evident package.

According to one aspect of the invention, a tamper-resistant package for an article to which access is intended only by destruction of the package comprises two webs of sheet material with inner surfaces secured together around their peripheries to form the package, with the article lying between the webs, one of the webs having a solvent indicator ink printed thereon, said solvent indicator ink comprising an organic dye which, upon the application of a readily-available common organic polar or non-polar solvent which might be used in an attempt to open the package, bleeds to a visible part of the package.

The solvent indicator ink may comprise the organic dye in combination with an organic resin binder, and advantageously the binder is readily soluble in at least one solvent selected from the group consisting of alcohols, ketones, esters, and aliphatic and aromatic hydrocarbons.

The organic dye may comprise an azo dye, for example a solution of monoazopyrazolone dye in n-propanol and/or 2-naphthaleneol ((phenylazo)phenyl) azoalkyl derivative. Alternatively, the organic dye may comprise a hydroquinone dye, for example a solution of alkylaminoanthraquinone dye in xylene, such as Dupone Oil Blue B liquid. The resin may be a maleic anhydride adduct of gum rosin.

According to another aspect of the invention, one of said webs may carry a water sensitive coating which produces a visible indication if an attempt is made with water to open the package. The water sensitive coating may for example contain a blue-water-soluble dye, and may be incorporated in an adhesive coating on an inner surface of the web which functions to secure the periphery of the web to the other web.

According to yet another aspect of the invention, one of the webs may have a heat-sensitive ink printed thereon which produces a visible change when an attempt is made to open the package by the use of heat. Advantageously, the heat indicator ink may comprise a two component reactive system in a suitable base resin, for example a nitro-cellulose or polyamide resin.

One embodiment of the invention will now be described, by way of example, with reference to the accompanying drawing, which shows a diagrammatic side view of the right half of a lottery ticket package, the left half being a mirror image of the right half.

Referring to the drawing, a lottery ticket package comprises a rectangular front web 12 and a rectangular rear web 14 secured together around their peripheries and containing a folded lottery ticket 16. Alternatively, instead of containing a single ticket, the package may contain a series of tickets, such as a group of stapled tickets. Each web 12, 14 comprises a substrate 18 of suitable paper, preferably a mechanically weak paper such as a ground wood type which will tear if an attempt is made to separate the front web 12 from the rear web 14.

The inner surface of the paper substrate 18 of the front web 12 carries a layer 20 of interference lacquer comprising a resin and alcohol mixture, for example a mixture of a maleic anhydride adduct of gum resin with anhydrous alcohol in a ratio by weight of 30:70. The interference layer 20 in turn carries an opaque cohesive coating 22 containing small amounts of blue and black colouring material to render the coating opaque to visible light.

The opaque cohesive coating 22 carries a coating 24 of solvent indicator ink which is sensitive to a variety of polar and non-polar solvents, the ink comprising a mixture of red and yellow organic dyes with resin in ethyl acetate and alcohol. The solvent indicator ink 24 carries a further opaque cohesive coating 26 consisting primarily of a cohesive latex and also containing polyvinyl acetate, stabilizer, ammoniacal neutralizing agent, black colouring material and defoamer.

The outer surface of the paper substrate 18 is printed in a suitable ink with appropriate informatory and/or design material represented by the reference numeral 28. An antiblocking layer 29 is provided over the substrate 18 and design ink 28 to prevent the adhesive coatings from adhering to the paper substrate 18 during manufacture of the web when the web is rolled upon itself. The antiblocking layer 29 is a polyurethane thermal setting lacquer formed by a mixture of resin, ethyl acetate and catalyst.

The inner surface of the paper substrate 18' of the rear web 14 carries an interference lay 20' which in turn carries an opaque cohesive coating 22 which are the same as the corresponding layers 20, 22 on the substrate 18 of the web 12. The opaque cohesive coating 22' carries an opaque water-sensitive cohesive coating 30' which consists primarily of a cold seal cohesive and also contains a blue organic dye together with stabilizer and water.

The outer surface of rear paper substrate 18' carries an antiblocking layer 32' formed by dissolution of polyamide in isopropyl alcohol. The antiblocking layer 32' carried a layer 34' of heat sensitive ink formed by a two component reaction system in a nitrocellulose base resin. The heat sensitive layer 34' is overprinted with a design ink in the form of desired information and/or design, represented by the reference numeral 36' and a further antiblocking layer 32'' similar to the layer 32' is applied over the design ink 36.

The solvent indicator ink 24 is sensitive to tampering attempts by a large variety of polar or non-polar solvents, and such tampering causes the solvent indicator ink to migrate to the exterior of the package in a visible manner. The interference lacquer layers 20, 20' prevent or substantially prevent premature migration of the solvent indicator ink 24 through the paper substrates 18, 18'.

The water sensitive opaque coating 30' is sensitive to tempering attempts with water, and such tampering causes the blue dye thereof to migrate to visible parts of the package.

The heat sensitive ink 34 is sensitive to tampering attempts by the use of heat, and such tampering attempts cause the ink to permanently change colour in a readily visible manner, the antiblocking layer 32'' being transparent.

The opaque coatings 22, 26 of the front web 12 and the opaque coatings 22', 30' of the back web 14 are sufficiently opaque to visible light to ensure that information on the contained lottery ticket 16 cannot be read.

In a specific example of the described embodiment, the various layers were constituted as follows:

| | (by weight) |
|---|---|
| Antiblocking Layer 29 | |
| Morton 22 HIC resin | 32.2% |
| Ethyl acetate | 55.0% |
| Morton 9H1H catalyst | 12.8% |
| Interference Layer 20 | |
| Arochem 404 resin | 30.0% |
| Anhydrous alcohol | 70.0% |
| (Arochem 404 is a trademark of Spencer Kellogg). | |
| Opaque Coating 22 | |
| BASF Basoflex Blue 708 | 1.0% |
| BASF Luconyl Black | 2.0% |
| L0099 Industrial Adhesive | 97.0% |
| Solvent Indicator Ink 24 | |
| Morton Automate Red B | 10.0% |
| Morton Morfast Yellow 101 | 5.0% |
| Arochem 404 | 5.0% |
| Ethyl Acetage | 66.7% |
| Anhydrous Denatured Ethanol | 13.3% |
| Opaque Coating 26 | |
| Stein Hall Cold Seal 3064 | 61.5% |
| Nacan 32-0266 | 17.2% |
| Stabilizer TM-62 | 3.3% |
| 9HH1-Cl ammoniacal neutralizing agent | 15.0% |
| Luconyl Black | 3.0% |
| Opaque Water-Resistant Coating 30' | |
| Stein Hall Cold Seal 3065 | 66.0% |
| TM-62 Stabilizer | 2.8% |
| Brillian Blue FCF dye | 0.95% |
| Water | 7.4% |
| Nacan 32-0266 (polyvinyl-acetate) | 9.25% |
| 9HH1-Cl ammoniacal neutralizing agent | 13.6% |
| Heat Sensitive Ink 34 | |
| Two component reactive systems in a nitrocellulose base resin, with 80% of compound #52921 and 20% compound #58858 supplied by Gotham Colour Company Inc. | |
| Antiblocking Formula 32 | |
| Industrial Adhesives S0454 | 75.0% |
| Isopropyl Alcohol (93%) | 25.0% |

Other embodiments and examples of the invention will be readily apparent to a person skilled in the art.

What we claim as new and desire to protect by Letters Patent of the United States is:

1. A tamper-resistant package for an article to which access is intended only by destruction of the package, comprising two webs of sheet material having inner surfaces securable together around their peripheries to form the package with the article lying between the webs, a solvent indicator ink printed on one of the webs, said solvent indicator ink comprising an organic dye which bleeds to a visible part of the package upon application of a readily-available common polar or non-polar solvent, a water-sensitive coating on one of the webs which produces a visible indication if an attempt is made to open the package with water, a heat-sensitive ink printed on one of the webs which produces a visible change when an attempt is made to open the package by the use of heat.

2. A package according to claim 1 wherein the solvent indicator ink comprises an organic dye in combination with an organic resin binder.

3. A tamper-resistant package according to claim 2 wherein the organic resin binder is readily soluble in at least one solvent selected from the group consisting of alcohols, ketones, esters and aliphatic and aromatic hydrocarbons.

4. A package according to claim 1 wherein the solvent indicator ink comprises an azo dye.

5. A package according to claim 1 wherein the solvent indicator ink comprises a hydroquinone dye.

6. A package according to claim 1 wherein an interference layer is provided on at least one side of the solvent indicator ink to prevent premature migration of the solvent indicator ink through one or more of said webs of sheet material.

7. A package according to claim 6 wherein said interference layer comprises a resin and alcohol mixture.

8. A package according to claim 7 wherein said interference layer comprises a mixture of maleic anhydride adduct of gum resin with anhydrous alcohol.

9. A package according to claim 1 wherein the water sensitive coating comprises a blue water-soluble dye.

10. A package according to claim 9 wherein the water sensitive coating is incorporated in a cohesive on an inner surface of a web which functions to secure a periphery of the web to the other web.

11. A package according to claim 1 wherein the heat sensitive ink comprises a two component reactive system in a base resin.

12. A package according to claim 1 wherein the solvent indicator ink is provided on an inner side of one web.

13. A package according to claim 12 wherein the water sensitive coating is provided on an inner side of the other web.

14. A package according to claim 13 wherein the heat sensitive ink is provided on an outer side of one of the webs.

15. A package according to claim 12 wherein an interference layer is provided between the solvent indicator ink and said one web to prevent premature migration of the solvent indicator ink through said one web.

* * * * *